US005253152A

United States Patent [19]

Yang et al.

[11] Patent Number: 5,253,152

[45] Date of Patent: Oct. 12, 1993

[54] LIGHTWEIGHT PLUG-IN FLUORESCENT LAMP ASSEMBLY

[76] Inventors: Thien S. Yang, 292 Connells Point Road, Connells Point, Australia, 2221; Gin P. So, 1 Tsing Yung St., Cafeterial Beach N.T., Hong Kong

[21] Appl. No.: 766,190

[22] Filed: Aug. 12, 1991

[51] Int. Cl.[5] ..... F21V 23/00

[52] U.S. Cl. ..... 362/221; 362/226; 362/260; 362/368

[58] Field of Search ..... 362/221, 226, 260, 148, 362/217, 365, 368

[56] References Cited

U.S. PATENT DOCUMENTS

| | | | |
|---|---|---|---|
| 3,040,170 | 6/1962 | Chwan | 362/221 |
| 3,302,059 | 1/1967 | Haire | 362/221 |
| 3,514,590 | 5/1970 | Shaeffer | 362/221 |
| 4,626,747 | 12/1986 | Nilssen | 362/148 |
| 4,674,015 | 6/1987 | Smith | 362/260 |
| 4,692,795 | 9/1987 | Nakao | 362/260 |

*Primary Examiner*—Richard R. Cole

*Attorney, Agent, or Firm*—Jacobson and Johnson

[57] ABSTRACT

A plug-in fluorescent lamp assembly including a lightweight (e.g. plastic) light box that is adapted to either rest upon the existing support grid of a conventional false ceiling in a flush mounted arrangement or be attached directly to the ceiling in a surface mounted arrangement. The lamp assembly comprises a prewired electrical receptacle that is fixedly connected to the light box. Formed at one end of the receptacle is a socket at which the pins of one or more fluorescent tubes are to be removably received. Located at the opposite end of the receptacle is a terminal block that is to be detachably connected to a commercially available electronic ballast by which to drive the fluorescent tubes. By virtue of the plug-in or modular characteristics of the lamp assembly herein described, either a fluorescent tube and/or the ballast may be easily removed and quickly replaced in the event of failure without having to remove the light box from the ceiling or disturb the wiring of the receptacle.

20 Claims, 11 Drawing Sheets

LIGHTWEIGHT PLUG-IN FLUORESCENT LAMP ASSEMBLY

BACKGROUND OF THE INVENTION

1. Field of the Invention

This invention relates to a lightweight, plug-in fluorescent lamp assembly by which a fluorescent tube and electronic ballast may be easily connected to or removed from an electrical receptacle at a light box to facilitate the installation and repair of the lamp assembly.

2. Background Art

Conventional fluorescent lamp assemblies that are located within a false ceiling commonly include an electronic ballast and starter by which to power an associated fluorescent lamp. In the event of a failure, it may be difficult to access, remove and replace a defective ballast and/or starter. Moreover, specialized skill and equipment may be required to complete the task of removing and replacing the ballast or starter because of the wiring that is common to most conventional fluorescent lamp assemblies.

What is more, conventional fluorescent lamp assemblies are typically housed within a metallic light box that is usually characterized as cumbersome, heavy and difficult to transport. Consequently, installation of the conventional fluorescent lamp assembly may prove to be difficult. In addition, it may be necessary to attach support wires, or the like, from the metal light box to the roof so as to adequately compensate for the weight of the assembly.

What is still more, the fact that the light box is metal requires relatively complex electrical wiring to provide both power and safe electrical grounding, whereby the conversion from incandescent lighting to fluorescent lighting may be both time consuming and potentially hazardous or, otherwise, require the presence of one having the special technical skill needed for making such conversions.

It would be more desirable to have available a plug-in fluorescent lamp assembly that is formed from a lightweight, non-conductive (e.g. plastic) material so as to be easily and inexpensively installed, without requiring special skill on the part of the installer while permitting easy access to and removal of the assembly electronics for replacement in the event of failure.

SUMMARY OF THE INVENTION

In general terms, this invention relates to a lightweight, plug-in fluorescent lamp assembly comprising a non-metallic (e.g. molded plastic) light box to which a non-metallic, pre-wired electrical receptacle is affixed. A socket is formed at one end of the receptacle for removably receiving the contact pins of one or more fluorescent lamp tubes. A terminal block is located at the opposite end of the receptacle to be removably received within a cavity formed at a commercially available, non-metallic ballast. Power is provided from the ballast for igniting the fluorescent tubes by way of wires which extend through the electrical receptacle between the terminal block and the socket thereof. By virtue of the foregoing, either the fluorescent tubes or the ballast may be easily removed (i.e. unplugged) from the electrical receptacle and replaced in the event of failure without disturbing the wiring therebetween.

Because of the non-metallic construction of the lamp assembly, the ballast need only be connected to AC and neutral power lines. The ballast is powered from such lines by way of wires that extend between a slide-out terminal and the terminal block of the electrical receptacle, whereby the lighting assembly may be quickly and easily installed without special skill. Moreover, it will be easier to convert an existing incandescent lighting assembly to the fluorescent lighting assembly herein described without having to rewire the assembly so as to provide an electrical ground.

The lightweight light box is adapted to be flush mounted without the use of support cables by merely resting upon the existing support grid of a conventional false ceiling. In the alternative, the light box can be mounted directly to the surface of the ceiling. In the surface mounted case, a removable frame surrounds the light box to enhance the aesthetic appearance and shield the electrical components thereof.

DESCRIPTION OF THE PREFERRED EMBODIMENT

Figure 1:
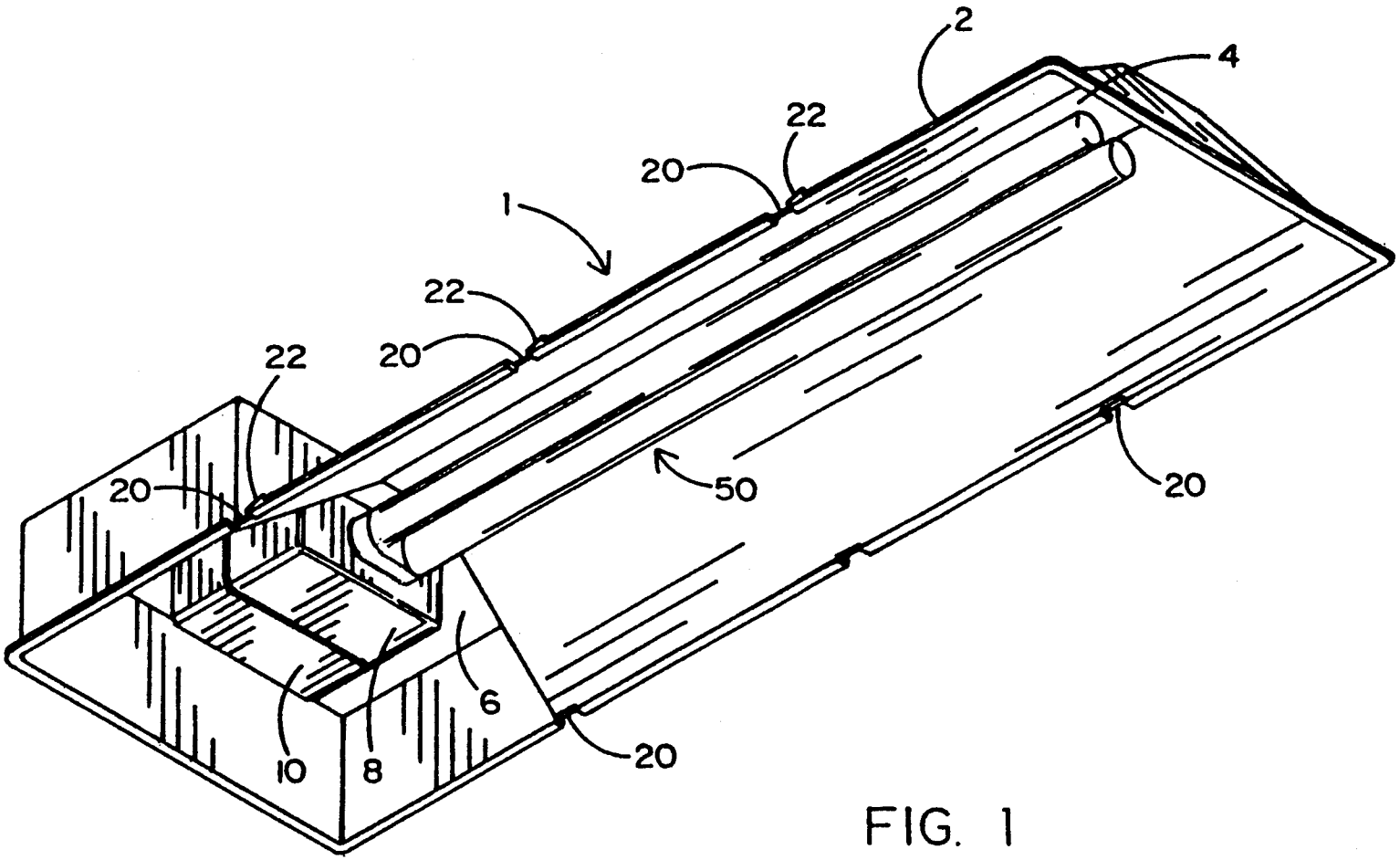
FIG. 1 is a bottom perspective view of the fluorescent lamp assembly which forms the present invention.

The lightweight, plug-in fluorescent lamp assembly 1 which forms the present invention is best described while referring to the drawings and to FIGS. 1-5 thereof where the efficient, modular characteristics of the invention are illustrated. The plug-in assembly 1 includes a generally rectangular, open-faced housing or light box 2 which is sized to fit within a conventional false ceiling. By way of example, light box 2 may have a length of 595 mm and a width of 200 mm. Located at one end of light box 2 is a lamp platform 4, above which a commercially available biaxial fluorescent lamp 50 is located. At the opposite end of light box 2 is a power platform 6, at which an electrical receptacle 8 and an electronic ballast 10 are located. The lamp platform 4 of light box 2 is preferably coated with a reflective surface (e.g. chrome plating) which is applied (e.g. vacuum deposited) by any suitable process. As will be described in greater detail hereinafter, the ballast 10 and fluorescent lamp 50 are detachably connected with (i.e. plugged into) receptacle 8 at the power platform 6 to facilitate the installation or relocation of plug-in assembly 1 and permit an easy replacement of either the ballast 10 and/or lamp 50 in the event of failure.

Figure 2:
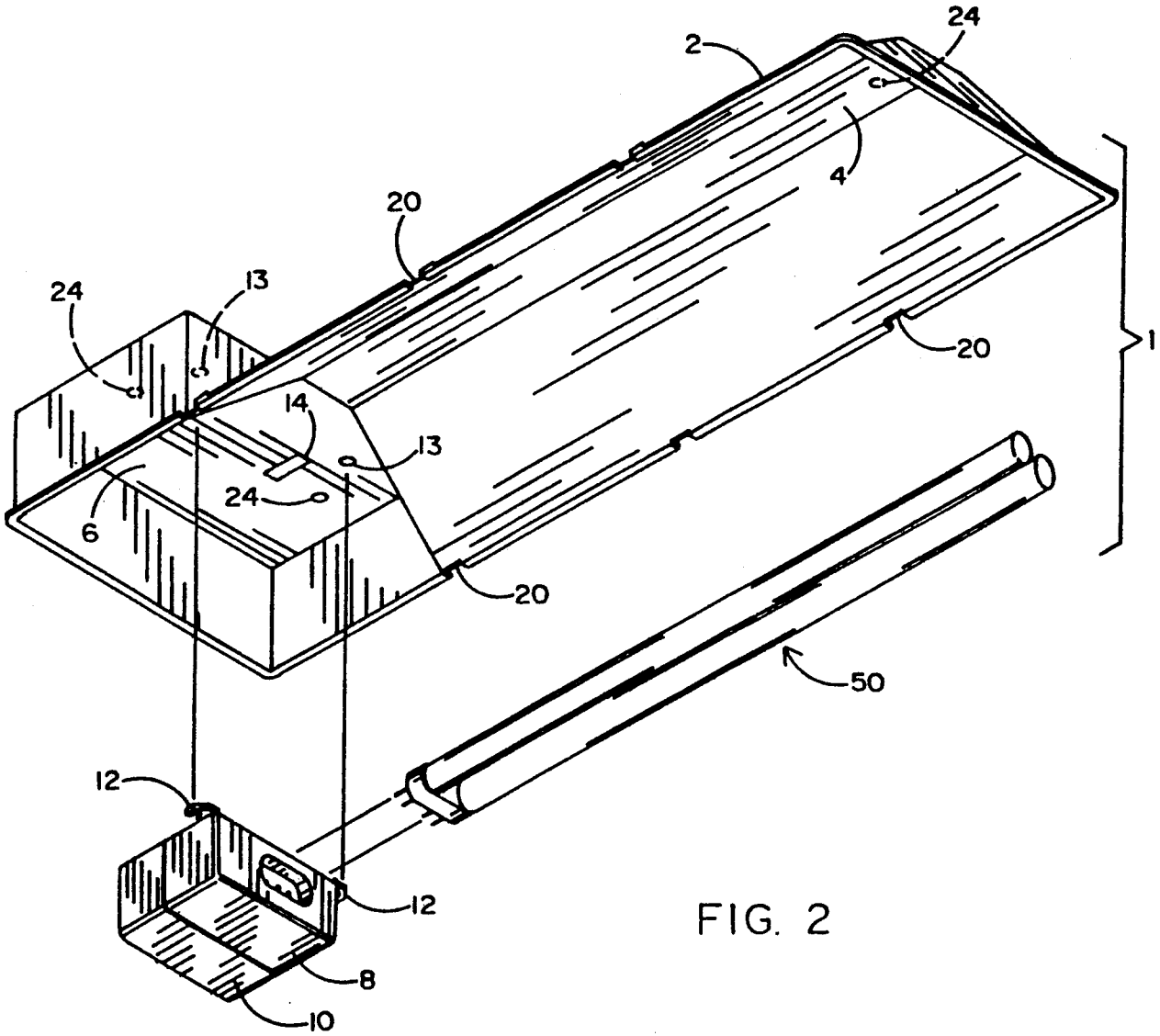
FIG. 2 is a partially exploded view of the fluorescent lamp assembly of FIG. 1.
Figure 3:
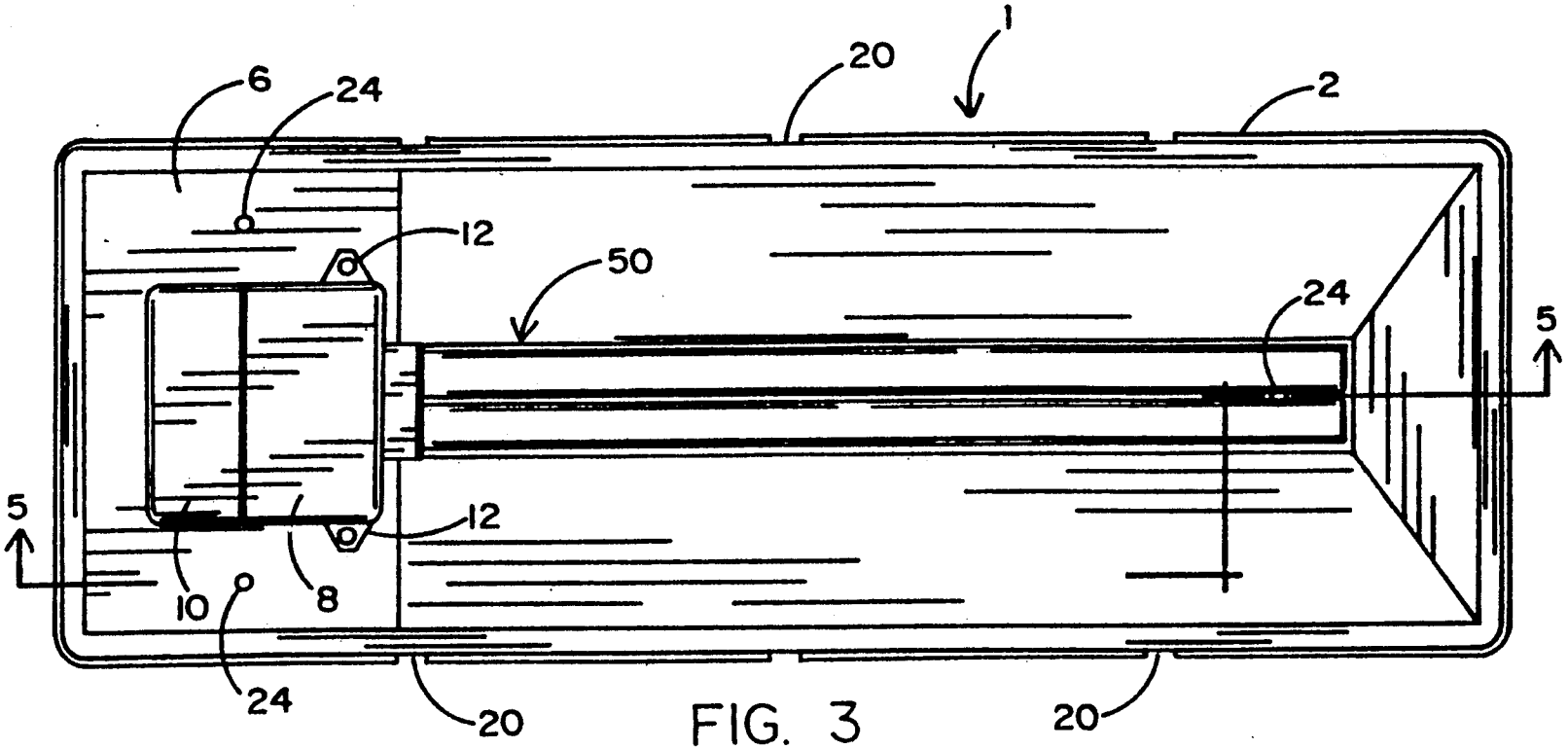
FIG. 3 is a bottom view of the fluorescent lamp assembly of FIG. 1.
Figure 4:
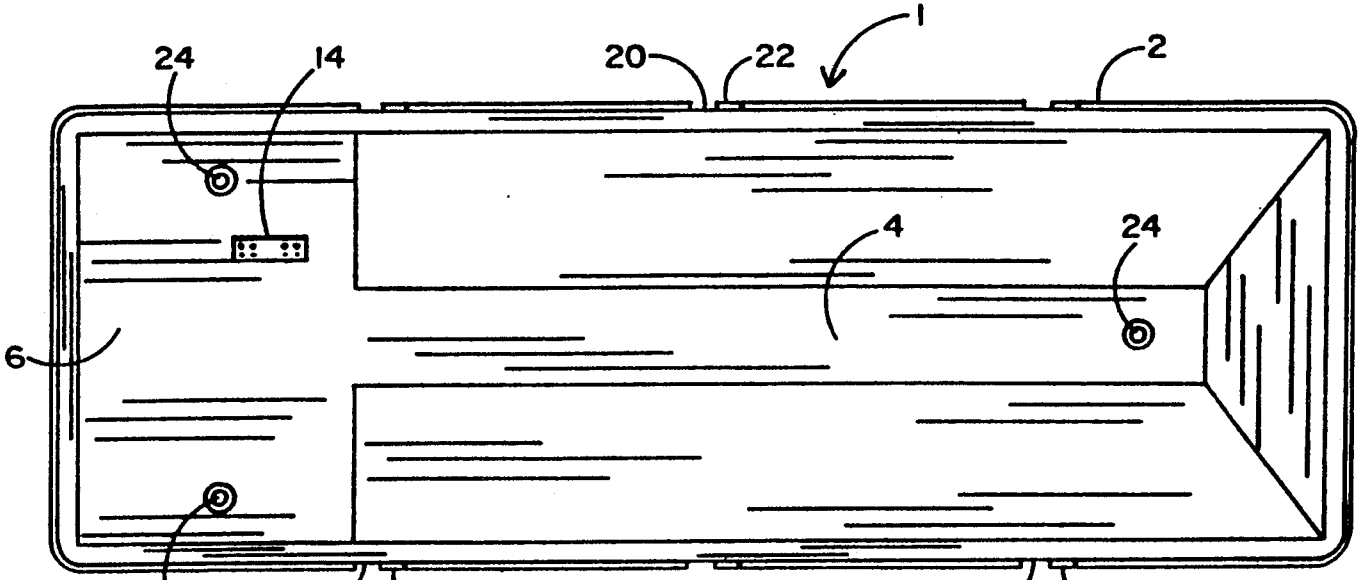
FIG. 4 is a bottom view of a light box which forms the fluorescent lamp assembly of FIG. 1.
Figure 5:
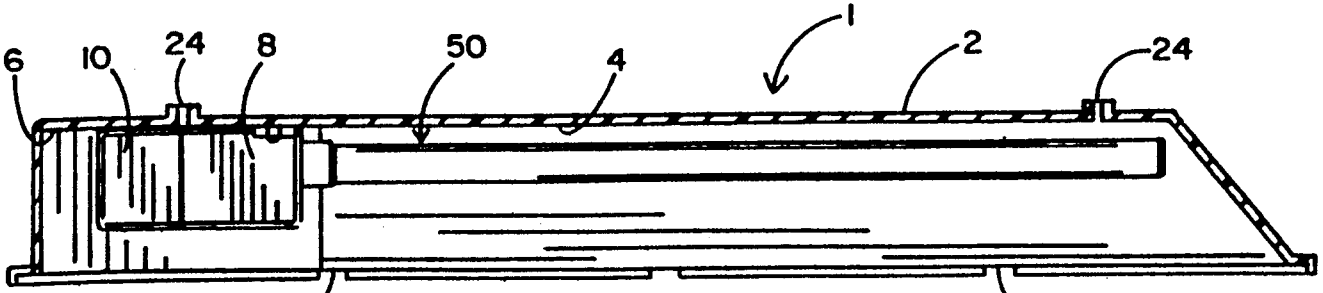
FIG. 5 is a cross-section taken along lines 5—5 of FIG. 3.

As is best shown in FIG. 2, the electrical receptacle 8 includes a pair of laterally extending ears 12, and power platform 6 of light box 2 includes a corresponding pair of holes 13 through which respective fasteners (not shown) may extend for securing the ears of receptacle 8 to light box 2. Since it is unlikely that the electrical receptacle 8 will need to be replaced, it is desirable to anchor said receptacle 8 at the power platform 6 of light box 2 so as to provide support for both the fluorescent lamp 50 at one end of the receptacle and the ballast 10 at the opposite end thereof. However, in the event that either the ballast 10 or lamp 50 need be replaced, said ballast or lamp may be quickly and easily removed (i.e. unplugged) from the receptacle 8 without any particular level of engineering skill or additional assistance.

It is preferable that the outer casings of light box 2, receptacle 8 and ballast 10 be manufactured (e.g. injection molded) from a lightweight, non-conductive material, such as polycarbonate or similar plastic. As an advantage of the non-conductive characteristic of plug-in lamp assembly 1, only hot (i.e. AC) and neutral power lines will be needed to energize electronic ballast 10. Therefore, the plug-in lamp assembly 1 of this invention can be advantageously used to easily and reliably convert a standard incandescent lighting fixture to a fluorescent lighting fixture without requiring rewiring to accommodate such conversion. To this end, an opening 14 (best shown in FIGS. 2 and 4) is formed through the power platform 6 of light box 2 through which existing hot and neutral power lines may be fed for connection to the receptacle 8 (in a manner that will be described when referring to FIGS. 10-15).

As an advantage of the lightweight characteristic of the plug-in lamp assembly 1, the light box 2 thereof is adapted to be received within a false ceiling without any support cables or attachments to the roof, as would otherwise be required to support heavier (e.g. metallic) fluorescent lamp assemblies. That is to say, the light box 2 can be mounted flush with the ceiling so as to rest upon standard T-shaped webs that commonly form a grid to support the acoustic tiles of a conventional false ceiling. Of course, it may be necessary to cut a tile to accommodate the light box within the ceiling. However, a plurality of lightweight, plug-in lamp assemblies of this invention may be conveniently located and easily installed within a false ceiling without disturbing the existing support grid or requiring complex and time-consuming attachments to the roof.

A semi-transparent diffuser plate (not shown) is used to cover the light box 2 and thereby close the open face thereof. In the case where the light box 2 is flush mounted, as described above, the diffuser plate rests upon the T-shaped webbing of the ceiling support grid so as to extend across the face of light box 2.

Figure 6:
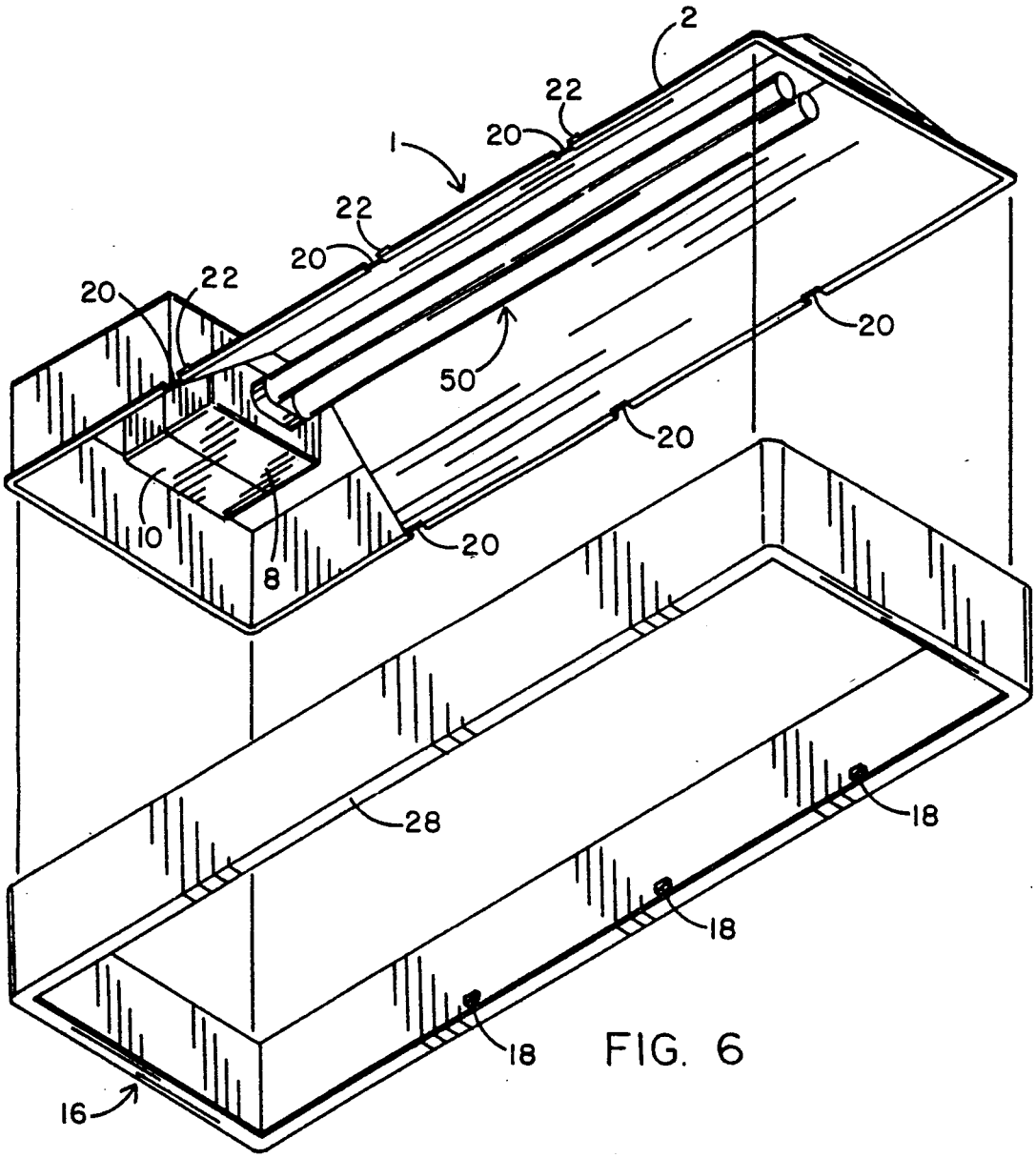
FIG. 6 is a partially exploded view of the fluorescent lamp assembly and a frame which surrounds the assembly in a surface mounted configuration.

As an alternative to the flush mounted lamp assembly described above, the plug-in assembly 1 of this invention is also advantageously adapted to be surface mounted for use in the home or in a similar structure where flush mounting is not practical or desired. More particularly, and referring concurrently to FIGS. 1-8 of the drawings, a rectangular, open ended frame 16 (best shown in FIGS. 6 and 7) is sized to surround plug-in lamp assembly 1. The frame 16 is slightly longer than light box 2 for a purpose that will soon be explained. Projecting inwardly in spaced axial alignment with one another from opposite sides of the frame 16 is a plurality of wedge shaped teeth 18. A corresponding plurality of axially spaced notches 20 are formed in opposite sides of the light box 2 of lamp assembly 1. Coextensively formed with light box 2 and projecting upwardly therefrom adjacent respective notches 20 are a plurality of ramps 22.

In order to surface mount the plug-in lamp assembly 1, the light box 2 is first connected to the ceiling. The foregoing is accomplished by inserting fastening means (not shown) into the ceiling via suitably located mounting holes 24 formed through the lamp and power platforms 4 and 6 of light box 2. With light box 2 securely attached to the ceiling (and receptacle 8, ballast 10 and fluorescent lamp 50 installed therein), the frame 16 is positioned around the light box 2, such that the inwardly projecting teeth 18 of frame 16 are received through the notches 20 and located above the ramps 22 of light box 2 (best shown in FIG. 8*a*). By applying a pushing force to frame 16, and inasmuch as the frame is slightly longer than light box 2, as previously disclosed, the frame will be displaced axially relative to light box 2 (as indicated by the reference arrow 26 of FIG. 8*a*), such that the teeth 18 of frame 16 are moved towards and into contact with respective ramps 22 of light box 2 (best shown in FIG. 8*b*). By virtue of the friction fit that is established between the wedge shaped teeth 18 and ramps 22, the housing 16 will be reliably and releasably mated to light box 2 (best known in FIG. 7).

Figure 8A:
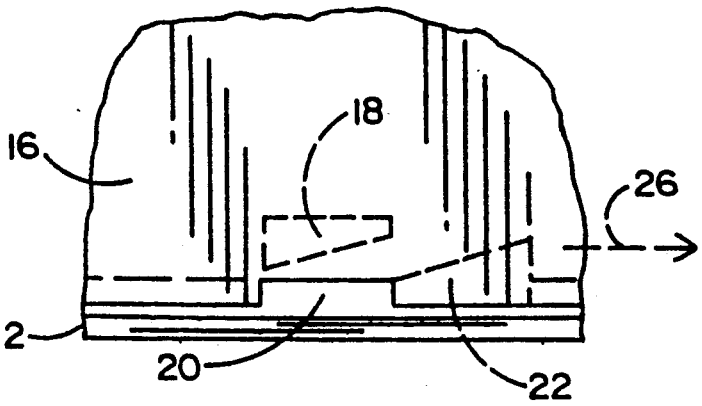
FIGS. 8*a* and 8*b* illustrate means by which the frame of FIGS. 6 and 7 is detachably connected to the light box of the lamp assembly in the surface mounted configuration.
Figure 8B:
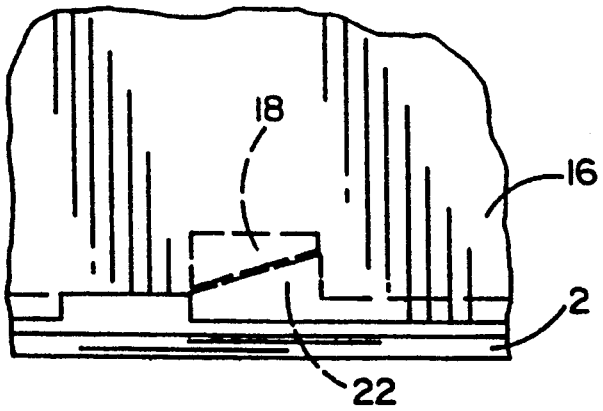

Should it be desirable to gain access to the plug-in lamp assembly for purposes of repair, the frame 16 can be easily removed from the light box 2 by applying another pushing force to frame 16, whereby to displace the frame in a direction opposite that indicated by reference arrow 26 of FIG. 8*a* and thereby separate the teeth 18 from the ramps 22. Frame 16 is then detached from light box 2 by withdrawing the teeth 18 of frame 16 through notches 20 of said light box.

Figure 7:
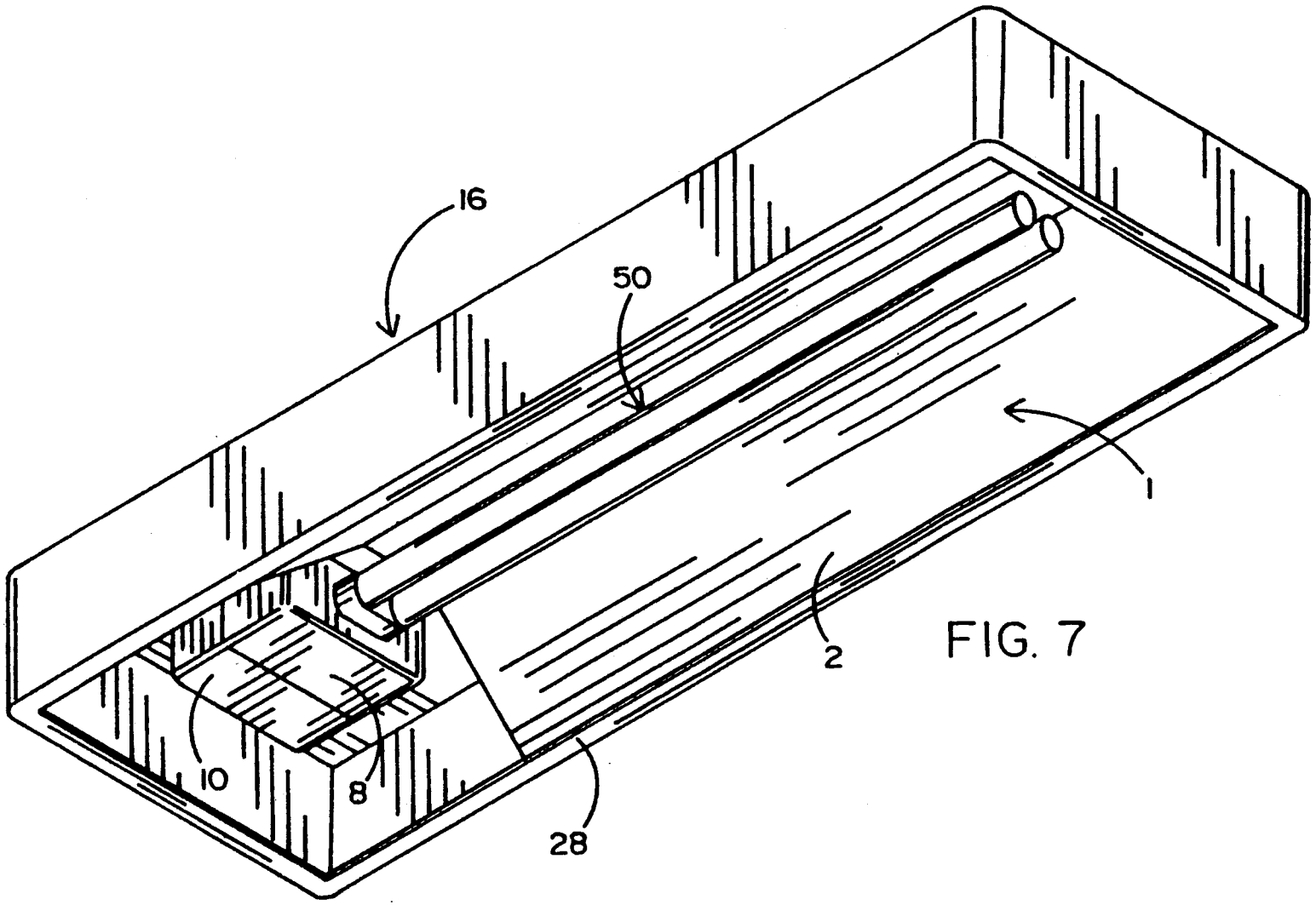
FIG. 7 shows the fluorescent lamp assembly surrounded by the frame of FIG. 6 in the surface mounted configuration.

As shown in FIG. 7, the frame 16 completely surrounds the plug-in lamp assembly 1 to enhance the aesthetic appearance (depending upon the color of frame 16) and isolate the otherwise exposed components 8, 10 and 50 thereof when the lamp assembly is surface mounted. What is more, the bottom of frame 16 is provided with an inwardly projecting peripheral lip 28. Like the flush mounted lamp assembly of FIGS. 1-5, the surface mounted assembly includes a semi-transparent diffuser plate (not shown). Such a diffuser plate will rest upon and be supported by the peripheral lip 28 of frame 16 so as to extend across the open face of light box 2.

Figure 9:
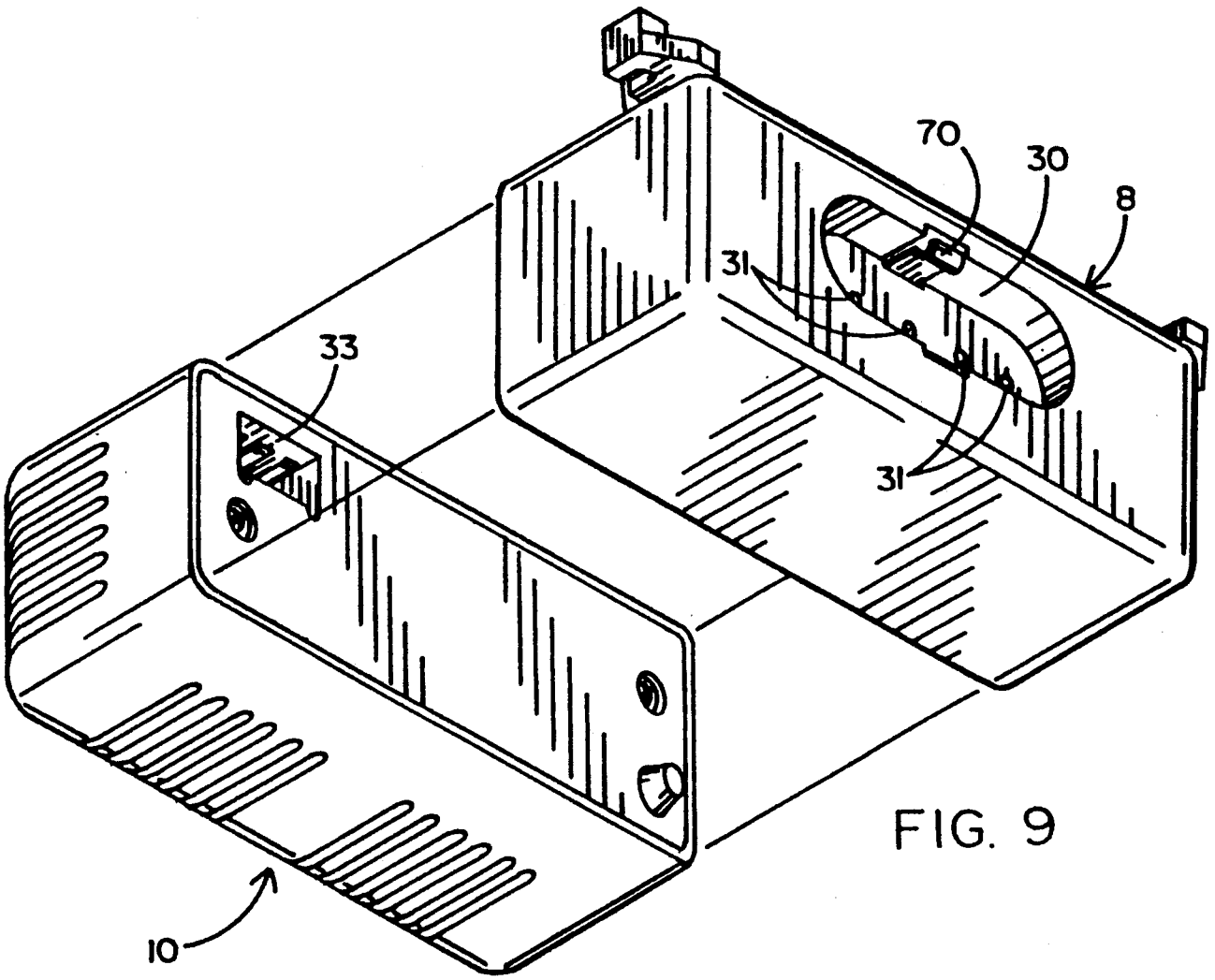
FIG. 9 illustrates the detachable, modular connection of an electronic ballast to an electrical receptacle which form the fluorescent lamp assembly.

FIG. 9 of the drawings shows details of the plug-in electrical receptacle 8 and electronic ballast 10 which form the fluorescent lamp assembly of FIGS. 1-8. More particularly, the receptacle 8 has a generally hollow rectangular housing. A socket 30 is molded into the front of receptacle 8 so as to receive the contact pins of an associated fluorescent lamp (designated 50 in FIGS. 1–8). Inasmuch as the fluorescent lamp described herein is of the biaxial type, the socket 30 of receptacle 8 is provided with a total of four pin holes 31 to receive respective contact pins from the tubes of such lamp. However, it is to be expressly understood that the type of lamp and number of fluorescent tubes that are plugged into receptacle 8 at socket 30 are not to be regarded as a limitation of the present invention. Connected at the interior of receptacle 8 and extending into the socket 30 thereof is a support bracket 70 which is adapted to releasably engage and retain the fluorescent lamp and prevent the inadvertent removal of the lamp contact pins from pin holes 31.

Figure 10:
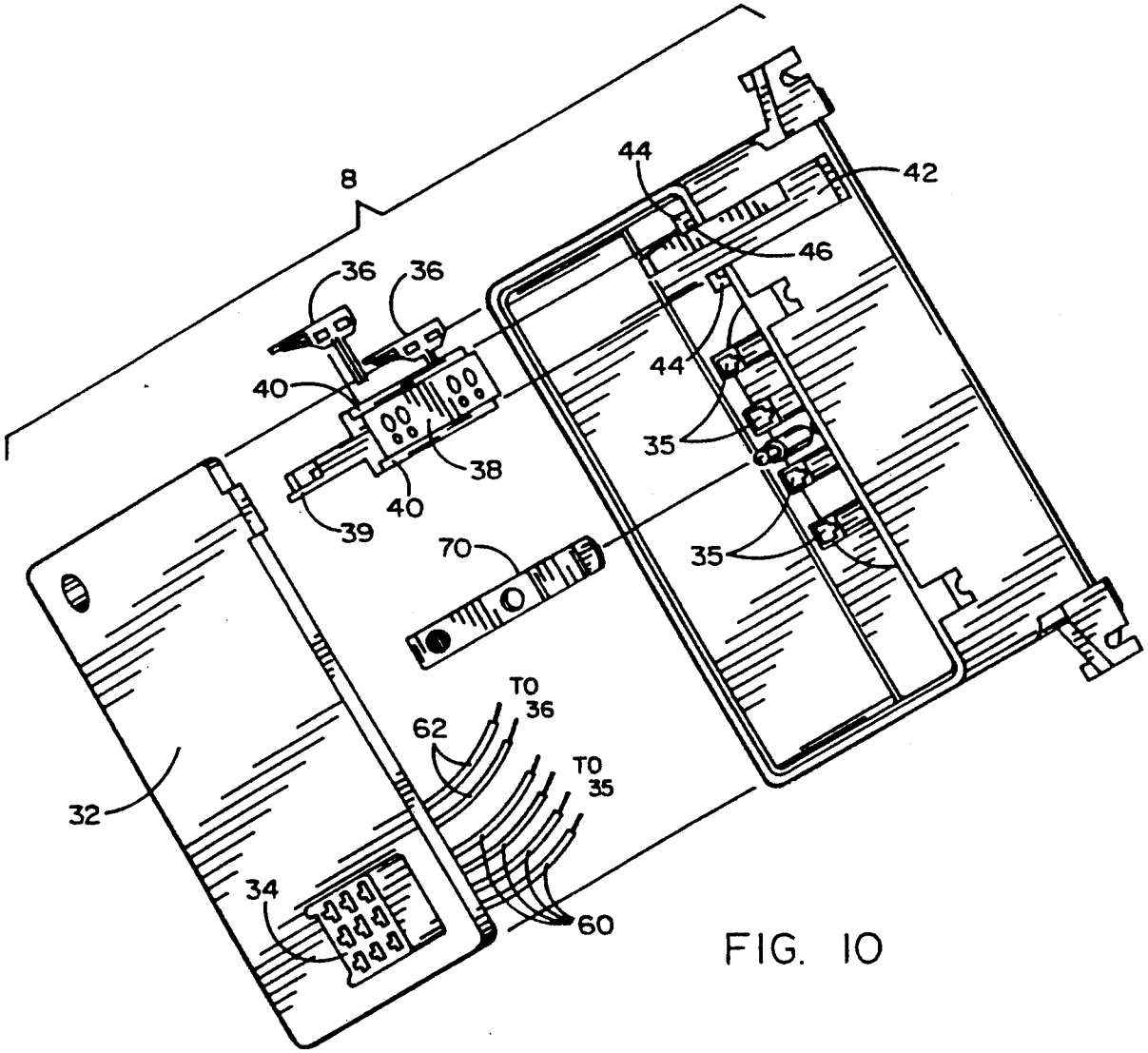
FIG. 10 is an exploded view of the electrical receptacle of FIG. 9.

As is best shown in FIG. 10, the back of electrical receptacle 8 is closed by a removable cover plate 32. Projecting outwardly from cover plate 32 is a terminal block 34. Terminal block 34 is sized to be removably received within a suitably sized terminal cavity 33 of electronic ballast 10 (best shown in FIG. 9), whereby said ballast is detachably and electrically connected to receptacle 8. The terminal block 34 of receptacle 8 is provided with a total of nine electrical contacts, although, for purposes of this invention, only six of such contacts are used. More particularly, four contacts of terminal block 34 at the back of receptacle 8 are electrically connected, by means of a set of four wires 60, to respective snap-in contacts (not shown) that are located at inwardly projecting terminals 35. Terminals 35 communicate with respective pin holes 31 in the socket 30 (of FIG. 9) at the front of receptacle 8 to complete an electrical path between said socket and the ballast 10 for driving the fluorescent lamp. An additional two terminals of terminal block 34 are electrically connected, by means of a set of two wires 62, to respective electrical contacts 36 which are received at a slide-out terminal plate 38 that is located at the bottom of electrical receptacle 8.

Figure 11:
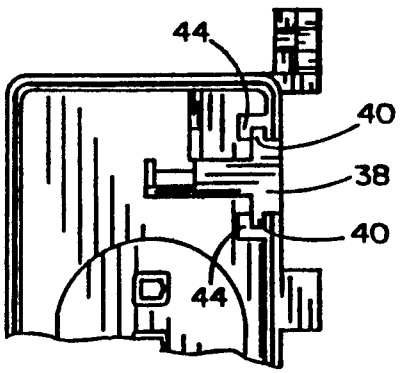
FIG. 11 shows a slide-out terminal plate received within a slot at the bottom of the electrical receptacle.

More particularly, and as is best shown in FIGS. 10 and 11, the slide-out terminal plate 38 is generally T-shaped and includes a vertical base 39 and a pair of laterally extending wings 40. A slot 42 is formed through the bottom of receptacle 8. A pair of oppositely aligned guide members 44 project from the bottom of receptacle 8 and extend above the slot 42 therein so that a narrow channel 46 is established between guide members and the receptacle 8. In the assembled configuration shown in FIG. 11, the wings 40 of terminal plate 38 are slidably received within the channel 46 at the bottom of receptacle 8. Hence, the terminal plate 38 can be displaced through slot 42 so as to be removed from receptacle 8 to thereby permit easy access to said terminal plate and to the electrical contacts 36 thereof.

Referring concurrently to FIGS. 10–14 of the drawings, the electrical contacts 36 of slide-out terminal plate 38 are shown connected to the wires 62 (of FIG. 10). The terminal plate 38 is provided with a pair of contacts 36, inasmuch as the lamp assembly of this invention need only be interconnected with hot and neutral power wires from an AC source (as previously disclosed). Each contact 36 is of conventional design and has a flat tab 52 within which are formed a pair of pivotable gripping jaws 54-1 and 54-2. The hot and neutral wires (e.g. 64) from the AC source are detachably connected to first gripping jaws (e.g. 54-1) of each contact 36. That is to say, the hot and neutral wires (only one of which 64 being shown in FIG. 13) extend through the opening (designated 14 in FIGS. 2 and 4) in the power platform 6 of light box 2 for connection to respective contacts 36 of terminal plate 38. The other gripping jaws 54-2 of each contact 36 are provided to receive jumper wires (not shown) in the event that it is desirable to interconnect a plurality of lamp assemblies in electrical parallel.

Each contact 36 also has a sleeve 56 which is coextensively connected to and perpendicularly aligned with base 39. The pair of wires 62 (of FIG. 10) are fixedly connected between terminal block 34 at the back of receptacle 8 to the sleeves 56 of respective contacts 36 of terminal plate 38 at the bottom of said receptacle to complete an electrical path from the AC source to the terminal block 34 so as to energize the electronic ballast 10 when the terminal cavity 33 of ballast 10 and the terminal block 34 of receptacle 8 are detachably connected together.

Figure 12:
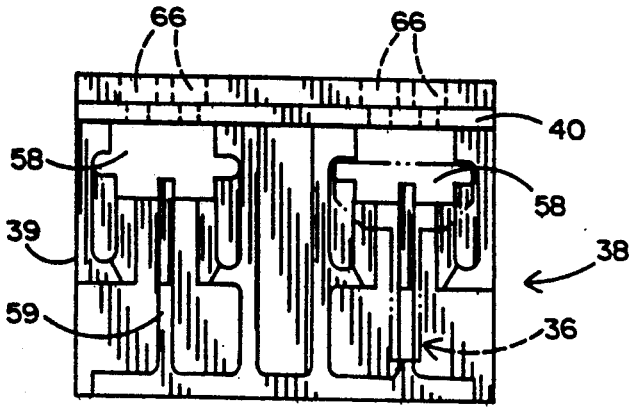
FIG. 12 is a front view of the slide-out terminal plate of FIG. 11.
Figure 13:
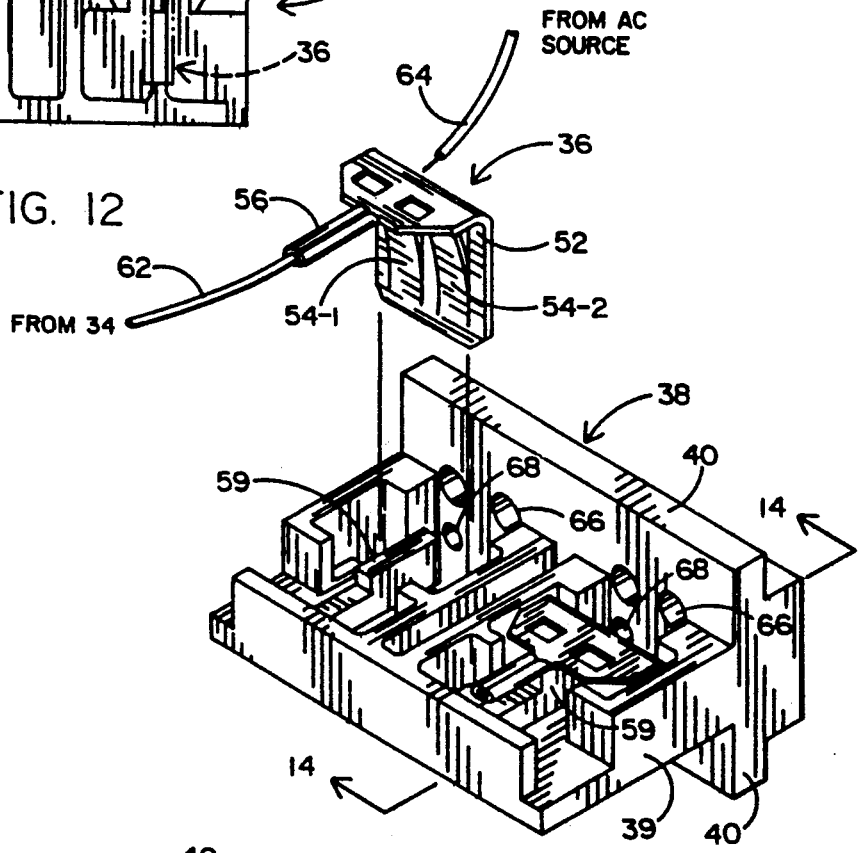
FIG. 13 is a perspective view of the slide-out terminal plate showing a pair of contacts received therein.
Figure 14:
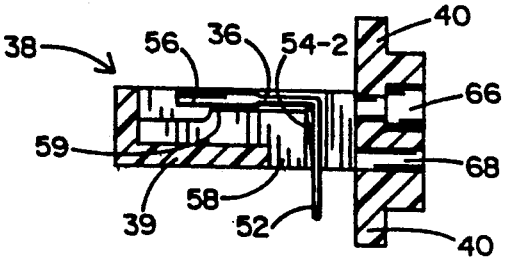
FIG. 14 is a cross-section taken along lines 14—14 of FIG. 13.

As is best shown in FIGS. 12–14, the terminal plate 38 is formed with a pair of openings 58 which communicate with respective cradles 59. In the assembled configuration, contacts 36 are attached to and carried by the terminal plate 38, such that the tab 52 of each contact is received through an opening 58, and the perpendicularly aligned sleeve 56 of each contact is supported upon a cradle 59. Accordingly, and as best shown in FIG. 14, each tab 52 in which a pair of gripping jaws 54-1 and 54-2 is formed is located adjacent an upper and lower row of holes 66 and 68 formed through the laterally extending wings 40 of terminal plate 38. One hole 66, 68 from each row is in spaced alignment with a respective jaw 54-1 or 54-2 from the contacts 36.

Figure 15:
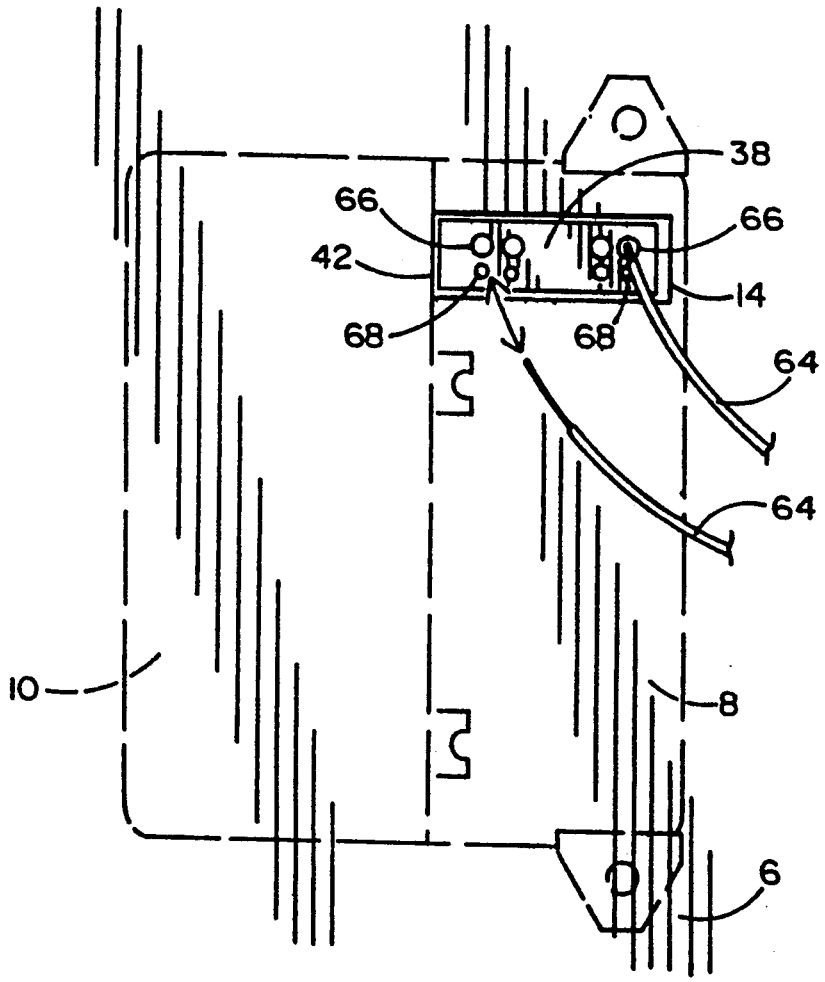
FIG. 15 is a bottom view showing the electrical receptacle and electronic ballast connected together with power wires detachably connected at the slide-out terminal plate of said receptacle.

The advantage of holes 66 and 68 is now described while referring to FIG. 15. With the slide-out terminal plate 38 received within the slot 42 at the bottom of electrical receptacle 8, each pair of holes 66, 68 through terminal plate 38 is, as previously disclosed, in spaced alignment with a respective gripping jaw (54-1 and 54-2 in FIG. 13) from the contacts 36 of said terminal plate. Therefore, by inserting the power (i.e. hot and neutral) wires 64 through respective holes 66, said wires will be automatically and detachably connected to contacts 36 at the gripping jaws thereof. Should it be desirable to detach power wires 64 from contacts 36 and receptacle 8, then a pin (not shown) or other suitably sized article is inserted through the other holes 68 to cause the gripping jaws of contacts 36 to rotate out of engagement with and thereby release such wires 64. Hence, the electrical receptacle may be easily and quickly connected to or detached from an AC power source without special tools or skill by simply plugging power wires 64 into holes 66 or inserting releasing pins into holes 68. The unused holes 66, 68 formed through the slide-out terminal plate 38 at the bottom of receptacle 8 are to receive (or remove) jumper wires for a purpose that was earlier described.

It will be apparent that while a preferred embodiment of the invention has been shown and described, various modifications and changes may be made without departing from the true spirit and scope of the invention. For example, the electrical receptacle 8 of the plug-in lamp assembly 1 could be sized to include more than one socket 30 by which to accommodate any number of fluorescent tubes. Moreover, such receptacle could also be detachably interconnected with either a single or twin ballast according to the teachings of this invention.

Having thus set forth a preferred embodiment of the present invention, what is claimed is:

1. A lighting assembly including at least one fluorescent tube and comprising:

an electrical receptacle having a socket in which to detachably receive the pins of the fluorescent tube and first electrical terminal means, said receptacle also having a first set of electrical conductors extending between said first terminal means and said socket; and an electronic ballast having electrical terminal means which is detachably connected to the first terminal means of said electrical receptacle for completing an electrical path by way of the first set of electrical conductors of said receptacle for driving the fluorescent tube, said electrical receptacle also having second terminal means connected to power lines from a source of power and a second set of electrical conductors extending between the first and second terminal means of said receptacle to complete an electrical path from said source to energize said electronic ballast when the terminal means of said ballast is detachably connected to the first terminal means of said receptacle, the second terminal means of said electrical receptacle including contact means to which said second set of electrical conductors are fixedly connected, said contact means having pivotable gripping jaws at which the power lines from the power source are detachably connected.

2. The lighting assembly recited in claim 1, wherein said electrical receptacle and said electronic ballast have outer casings that are formed from a non-conductive material.

3. The lighting assembly recited in claim 1, further comprising a light box within which said electrical receptacle, said electronic ballast and the fluorescent tube are received, said receptacle being fixedly attached to said light box, and said ballast and fluorescent tube being detachable from said receptacle and removable from said light box.

4. The lighting assembly recited in claim 3, wherein said light box is manufactured from a non-conductive material.

5. The lighting assembly recited in claim 3, further comprising a frame to surround said light box, and means by which to detachably connect said frame to said light box.

6. The lighting assembly recited in claim 5, wherein said means to detachably connect said frame to said light box includes a first plurality of locking members around a periphery of said frame and a second plurality of locking members around a periphery of the light box, said first and second pluralities of locking members being movable into interlocking engagement with one another when said frame surrounds said light box.

7. The lighting assembly recited in claim 6, further including a plurality of openings formed around the periphery of said light box to receive therethrough respective ones of the first plurality of locking members of said frame to permit said first locking members to be located above and moved into contact with corresponding ones of the second plurality of locking members of said light box.

8. The lighting assembly recited in claim 7, wherein each of said first plurality of locking members is wedge-shaped and each of said second plurality of locking members is ramp-shaped, such that said wedge-shaped and ramp-shaped locking members frictionally engage one another to detachably connect said frame to said light box.

9. The lighting assembly recited in claim 1 wherein said electrical receptable has a slot formed therein, said second terminal means being received in and slidable through said slot to be removed from said receptacle.

10. The lighting assembly recited in claim 1, further comprising first openings extending through the second terminal means of said electrical receptacle, such that the power lines from the power source are detachably connected at the gripping jaws of the contact means of said second terminal means by way of said first openings.

11. The lighting assembly recited in claim 10, further comprising second openings extending through the second terminal means of said electrical receptacle, the gripping jaws of said contact means of said second terminal means being accessible through said second openings to enable said power lines to be detached from said contact means and said receptacle disconnected from said power source.

12. A detachable fluorescent lighting assembly including at least one fluorescent tube and comprising:

an electronic ballast having electrical terminal means to receive power supplied from a source thereof; and an electrical receptacle having a socket in which to detachably receive the pins of the fluorescent tube, first electrical terminal means to be detachably connected to the terminal means of said electronic ballast, a first set of electrical conductors extending between said first terminal means and said socket to complete an electrical path from said ballast to the fluorescent tube to drive said tube, second terminal means detachably connected to the source of power by way of power lines, and a second set of electrical conductors extending between said first and second terminal means to complete an electrical path from said source to said ballast and thereby energize said ballast, the second terminal means of said electrical receptacle including contact means to which said second set of electrical conductors are fixedly connected, said contact means having pivotable a gripping jaws at which the power lines from the power source are detachably connected, such that said receptacle can be disconnected from said source when the power lines are detached from the contact means of said second terminal means.

13. The detachable lighting assembly recited in claim 12, further comprising a light box within which said electrical receptacle, said electronic ballast and the fluorescent tube are received, said receptacle being fixedly attached to said light box, and said ballast and fluorescent tube being detachable from said receptacle and removable from said light box.

14. The detachable lighting assembly recited in claim 13, wherein each of said electronic ballast, said electrical receptacle and said light box has an outer casing that is manufactured from a non-conductive material.

15. The detachable lighting assembly recited in claim 12, wherein said electrical receptacle has a slot formed therein, said second terminal means being received in and slidable through said slot to be removed from said receptacle.

16. The lighting assembly recited in claim 12, further comprising first openings extending through the second terminal means of said electrical receptacle, such that the power lines from the power source are detachably connected at the pivotable gripping jaws of the contact means of said second terminal means by way of said first openings.

17. The lighting assembly recited in claim 16, further comprising second openings extending through the second terminal means of said electrical receptacle, the pivotable gripping jaws of said contact means of said second terminal means being pivoted via said second openings to enable said power lines to be detached from said contact means and said receptacle disconnected from said power source.

18. A detachable fluorescent lighting assembly including at least one fluorescent tube and comprising:

an electrical receptacle having a socket in which to detachably receive the pins of the fluorescent tube and first electrical terminal means, said receptacle also having a first set of electrical conductors extending between said first terminal means and said socket;

an electronic ballast having electrical terminal means which is detachably connected to the first terminal means of said electrical receptacle for completing an electrical path by way of the first act of electrical conductors of said receptacle for driving the fluorescent tube;

a light box within which said electrical receptacle, said electronic ballast and the fluorescent tube are received, said receptacle being fixedly attached to said light box, and said ballast and fluorescent tube being detachable from said receptacle and removable from said light box; and a frame surrounding said light box and means by which to detachably connect said frame to said light box, said means to detachably connect said frame to said light box including a first plurality of locking members around a periphery of said frame and a second plurality of locking members around a periphery of said light box, said first and second pluralities of locking members being movable into interlocking engagement with one another when said frame surrounds said light box.

19. The detachable lighting assembly recited in claim 18, further including a plurality of openings formed around the periphery of said light box to receive therethrough respective ones of the first plurality of locking members of said frame to permit said first locking members to be located above and moved into contact with corresponding ones of the second plurality of locking members of said light box.

20. The detachable lighting assembly recited in claim 19, wherein each of said first plurality of locking members is wedge-shaped and each of said second plurality of locking members is ramp-shaped, such that said wedge-shaped and ramp-shaped locking members frictionally engage one another to detachably connect said frame to said light box.

* * * * *